US005191925A

United States Patent [19]

Sosin

[11] Patent Number: 5,191,925

[45] Date of Patent: Mar. 9, 1993

[54] ROLL FOR A DEVICE FOR THE DIRECT CONTINUOUS CASTING OF THIN STRIPS OF MOLTEN METAL

[75] Inventor: Laurent Sosin, Fameck, France

[73] Assignee: Usinor Sacilor, Puteaux, France

[21] Appl. No.: 818,784

[22] Filed: Jan. 9, 1992

Related U.S. Application Data

[63] Continuation-in-part of Ser. No. 591,292, Oct. 1, 1990, abandoned.

[30] Foreign Application Priority Data

Oct. 2, 1989 [FR] France ..... 89 12855

[51] Int. Cl.[5] ..... B22D 11/06

[52] U.S. Cl. ..... 164/428; 164/429

[58] Field of Search ..... 164/428, 429, 479, 480, 164/448

[56] References Cited

FOREIGN PATENT DOCUMENTS

| | | | |
|---|---|---|---|
| 51-41635 | 4/1976 | Japan | 164/448 |
| 56-114562 | 9/1981 | Japan | 164/448 |
| 58-70959 | 4/1983 | Japan | 164/428 |
| 61-119357 | 6/1986 | Japan | 164/429 |
| 64-87048 | 3/1989 | Japan | 164/448 |

*Primary Examiner*—J. Reed Batten, Jr.

*Attorney, Agent, or Firm*—Fay, Sharpe, Beall, Fagan, Minnich & McKee

[57] ABSTRACT

An apparatus for the direct continuous casting of thin strips of molten metal comprises a source of molten metal and at least one cooled roll which receives the molten metal, wherein the at least one cooled roll includes a cylindrical inner core, a first sleeve enclosing the inner core, cooling channels provided between the first sleeve and the core and a second sleeve enclosing the first sleeve and being in contact with the molten metal. The second sleeve forms with the first sleeve two superposed cylindrical layers which are chosen of materials such that the first sleeve has a coefficient of thermal expansion higher than that of the second sleeve. The thicknesses of the first and second sleeves are chosen in relation to the thermal conductivity and coefficient of thermal expansion of the materials from which the sleeves are formed, so as to reduce when the apparatus is in use, the difference between an axial expansion of the first sleeve, which is maintained at a low temperature by a circulating cooling fluid in the cooling channels, and an axial expansion of the second sleeve which is maintained at a high temperature due to its contact with the molten metal.

16 Claims, 3 Drawing Sheets

ROLL FOR A DEVICE FOR THE DIRECT CONTINUOUS CASTING OF THIN STRIPS OF MOLTEN METAL

This application is a continuation-in-part of application Ser. No. 07/591,292 filed Oct. 1, 1990, and now abandoned.

The subject of the present invention is a roll for a device for the direct continuous casting of thin strips of molten metal between two rolls, or on a single roll.

As is known, these rolls comprise a cylindrical core covered with a sleeve which is generally made from copper and are cooled by the circulation of a cooling fluid, such as water, in channels provided between the sleeve and the core or in the sleeve. In point of fact, it is observed that the rolls produced in this way undergo outward bulging during casting, so that the products cast between two rolls which bulge in this way have a "dog-bone" profile. As their thickness at the ends is thus greater than their thickness in the central zone, such products are therefore unsatisfactory.

In the case of casting on a single roll, the bulging of the latter renders the play between the molten metal feed device and the roll non-uniform. The latter may therefore come into contact with the feed refractory and damage it.

The aim of the invention is to produce rolls which make it possible to eliminate this drawback and consequently to obtain castings with a profile of satisfactory thickness.

According to the invention, the roll comprises, around the first sleeve, a second sleeve forming, with the first, two superposed cylindrical layers chosen from materials such that the inner sleeve has a coefficient of thermal expansion higher than that of the outer sleeve which is in contact with the molten metal.

The coefficients of expansion and thus the corresponding materials are chosen so that the differential expansion between the two materials offsets the tendency of the double sleeve thus produced to bulge, in particular at the level of the gap between the rolls.

The inner sleeve can, for example, be made from copper, whereas the outer sleeve can be made from steel. These two sleeves can be welded to one another, if desired.

Other features and advantages of the invention will become apparent from the following description which is made with reference to the appended drawings which illustrate two non-limiting embodiments thereof by way of example.

Figure 1:
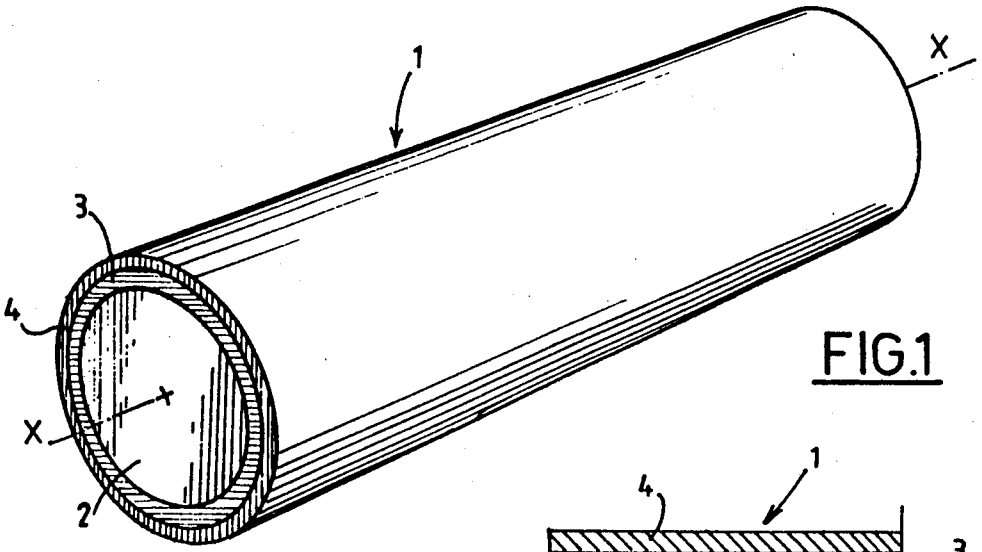
FIG. 1 is a perspective view of a roll comprising a double sleeve according to a first preferred embodiment of the invention and intended for a device for the continuous casting of thin strips of metal.

The roll 1 shown in FIG. 1 of the drawings is intended for a device for the production of thin metal strips by direct continuous casting of molten metal, such as steel, between two similar rolls 1. Such a device is well known per se and has therefore not been shown.

The roll 1, of axis XX, comprises an inner cylindrical core 2 and of two superposed annular sleeves 3, 4 which surround the inner core 2, in which are provided cooling channels 5 through which water can circulate. The two superposed layers 3 and 4 are chosen from materials such that the inner sleeve 3 has a coefficient of thermal expansion higher than that of the outer sleeve 4 in contact with the molten metal.

The two sleeves 3 and 4 are joined to one another, for example by welding, by charging of one of the materials on the other, or by electrolytic deposition. By way of non-limiting example, the inner sleeve 3 is made from copper and the outer sleeve 4 from steel, the copper in fact having a coefficient of thermal expansion higher than that of the steel.

The thicknesses of the two layers 3 and 4 are adjusted as a function of the coefficients of thermal expansion and the thermal conductivities of the materials chosen. More specifically, the thicknesses of the first and second sleeves are chosen, in relation to the thermal conductivity and coefficient of thermal expansion of the materials from which the sleeves are formed, so as to reduce, when the apparatus is in use, the difference between an axial expansion of the first sleeve, which is maintained at a low temperature by a circulating cooling fluid in the cooling channels, and an axial expansion of the second sleeve, which is maintained at a high temperature due to its contact with the molten metal.

The choice of appropriate thicknesses of the two layers 3 and 4 is very important. Indeed, the median temperature of each sleeve 3 and 4 varies in relationship with the thermal conductivity of the material forming each sleeve and with its thickness. This median temperature is approximately the temperature to be considered to determine the respective expansions of the sleeves. This can be illustrated by the following example.

Figure 5:
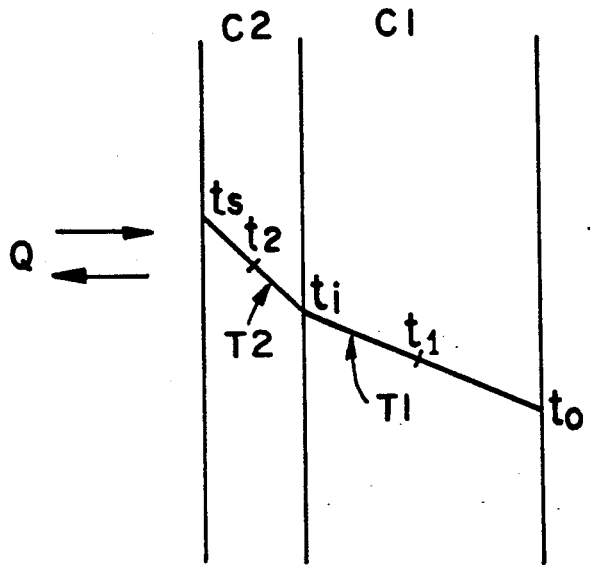
FIG. 5 is a thermal diagram illustrating a first pair of inner and outer sleeves; and, FIG. 6 is a thermal diagram illustrating a second pair of inner and outer sleeves.

With reference now to FIG. 5, C1 is the inner sleeve (the first sleeve 3) and C2 is the outer sleeve (the second sleeve 4). During casting, the temperatures in each sleeve can be represented by curves T1 and T2, the basic data being the temperature t0 of the inner sleeve at the level of the cooling channels, and the thermal flow Q to be extracted from the molten metal.

The value of Q and the thermal conductivity of the material forming the sleeve C1 determines the slope of the straight line T1 and, in relationship with the thickness of C1, the temperature ti at the interface, of both sleeves. A similar relationship exists for curve T2, in the sleeve C2 and ts, the surface temperature of the roll. By approximation, it is possible to take the median temperatures t1 and t2 to calculate the axial expansions of each sleeve. The axial expansions are:

$$\text{for C2}: \Delta = \alpha 2\ (t2 - t2^{\circ})$$

$$\text{and for C1}: \Delta = \alpha 1\ (t1 - t1^{\circ})$$

where $\alpha$ is the expansion coefficient and $t2^{\circ} = t1^{\circ}$ is the temperature out of use, i.e. the temperature during assembly of the sleeves.

Figure 6:
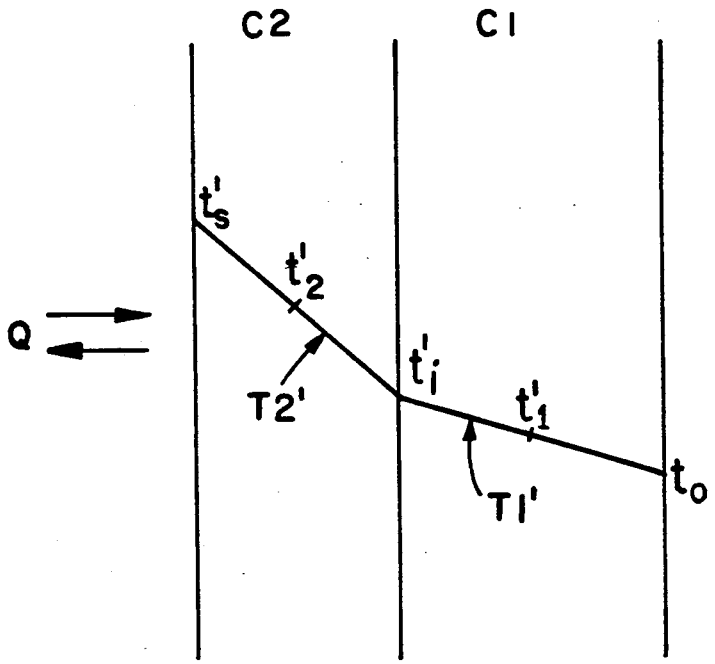

FIG. 6 illustrates that in the case of a thicker second sleeve C2, for t0 and Q constant, the surface temperature rises to t's, since the slope of the straight line T2' is not changed. Consequently, the median temperature t'2 of C2 rises as well.

It can therefore be readily understood that a tendency of the roll 1 to increase its bulging will occur since the outer sleeve will expand more. Therefore, in order to reach the desired result, the thicknesses of the two sleeves must be adjusted in relationship with the coefficient of thermal expansion of the materials used and also with their thermal conductivities. In other words, a material A can have a coefficient of thermal expansion higher than a material B while it has a lower heat conduction.

In the above examples, to reduce the tendency of the roll to bulge, the expansion coefficient of C1 is higher than that of C2 and, additionally, the thermal conductivity of C2 is lower than that of C1. Therefore, the thickness of C2 will be reduced as much as possible to decrease t2, and therefore the expansion of C2 and finally the bulging of the roll.

However, the minimum thickness of C2 will be limited, on the one hand by the strength necessary for C2 to remain integral and, on the other hand, by the surface temperature ts desired in relationship with the casting process. The determination of these limits is outside the field of this invention but does not pose a problem to one of average skill in the art.

It should be noted that the above explanation would also allow one of average skill in the art to modify the thickness of the inner sleeve or the total thicknesses of the two sleeves. It would also allow one of average skill in the art to use materials having different thermal characteristics. Therefore, one of average skill in the art would have no difficulty in determining the thickness of each sleeve in relationship with the materials chosen for the sleeves and with the conditions of the casting process.

It should be noted that the outer sleeve does not necessarily have to be thinner than the inner sleeve but can be thicker than the inner sleeve if desired. In this connection, one of average skill in the art can recognize that if, for example, the thermal conductivity of the material forming the outer sleeve is higher than that of the material forming the inner sleeve, which is not the preferred embodiment of the invention, but is not excluded from the invention, the differential expansion can be reduced—for a constant total thickness of both sleeves—by increasing the thickness of the external sleeve and correspondingly reducing the thickness of the inner sleeve. When this is done, the outer sleeve can have a thickness which is larger than that of the inner sleeve. One of average skill in the art will have no difficulty in determining the thicknesses to be used in each case when desired materials are chosen. Such choice is inherent to the normal technical knowledge of one of average skill in the art in the contemplated technical field.

Thus, when the double sleeve 3, 4 is subjected to the high temperature gradient encountered during contact of the outer sleeve 4 with the molten metal, the differential expansion between the two materials of the layers 3 and 4 offsets the tendency of the double sleeve to bulge, particularly at the level of the gap between the two rolls of the device.

The inner sleeve 3 is preferably made from copper and has a thickness of 5 to 30 mm. The outer sleeve may be made from steel, nickel or chromium and have a thickness of 1 to 10 mm.

By way of example:

roll: diameter 1,500 mm, width: 800 mm
inner sleeve: copper, thickness 15 mm
outer sleeve: steel or nickel; thickness 2 mm
the sleeves are joined to one another over the entire surface (outer sleeve consisting of a covering deposited on the inner sleeve)
temperature of the cast steel: 1,450°
temperature at the inner wall of the inner sleeve: 60° C. (substantially equal to the temperature of the cooling water).

result: the bulging of the roll is 0.3 mm, whereas, if the sleeve were made entirely from copper, the bulging would be approximately 1 mm.

It would be possible to further reduce the remaining bulging by choosing as the outer sleeve, a material which has a lower coefficient of thermal expansion and better thermal conductivity, such as chromium.

Figure 2:
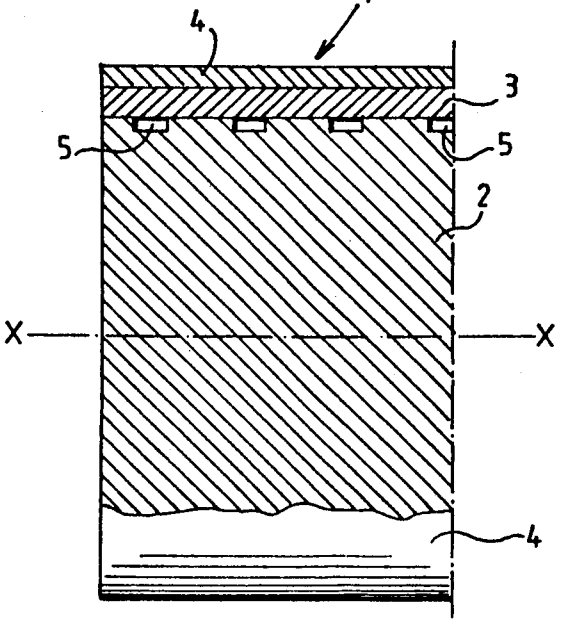
FIG. 2 is a view in partial axial section of the roll in FIG. 1.
Figure 4:
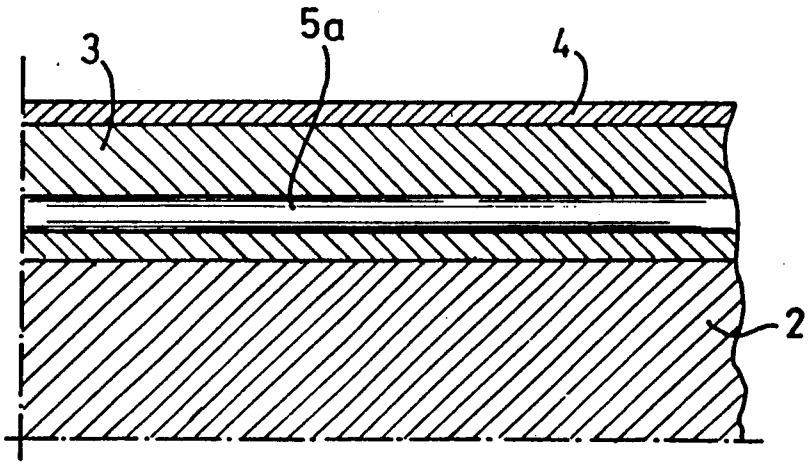
FIG. 4 is a cross sectional view of the roll of FIG. 3 along a longitudinal axis of the roll.
Figure 3:
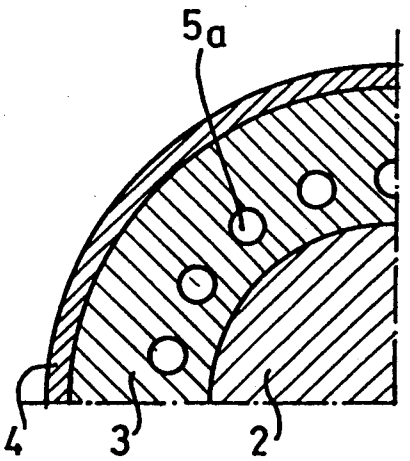
FIG. 3 is a cross sectional view of a portion of a roll comprising a double sleeve according to a second preferred embodiment of the invention, the roll being intended for a device for the direct continuous casting of thin strips of metal.

It should be pointed out that the invention is not restricted to an arrangement of cooling channels 5 under the double sleeve (3, 4), as shown in FIGS. 1 and 2. Instead, cooling channels 5a may be drilled in the inner sleeve 3 as shown in FIGS. 3 and 4.

It is appropriate also to point out that the thickness of the above mentioned sleeve made from copper corresponds to the case in which the cooling channels are provided under this sleeve. If the channels are provided in the inner sleeve, the thickness in question is the radial distance between these channels and the inner sleeve/outer sleeve interface since, in this case, the thickness of the inner sleeve located between the channels and the core is kept at a low temperature and has only a slight influence on the differential expansion effect.

The invention has been described with reference to preferred embodiments. Obviously, modifications and alterations will occur to others upon a reading and understanding of this specification. It is intended to include all such modifications and alterations insofar as they come within the scope of the appended claims or the equivalents thereof.

What is claimed:

1. An apparatus for the direct continuous casting of thin strips of molten metal, comprising:

a source of molten metal; and at least one cooled roll which receives the molten metal to be solidified, said at least one roll having a longitudinal axis around which it rotates, said at least one roll comprising:

a cylindrical inner core having a longitudinal axis, a first sleeve enclosing said inner core, said first sleeve having a longitudinal axis parallel to the axis of said core, cooling channels provided between said first sleeve and the core, and a second sleeve enclosing said first sleeve and being in contact with the molten metal, said second sleeve having a longitudinal axis parallel to the longitudinal axis of said first sleeve and the longitudinal axis of said core and forming, with said first sleeve, two superposed cylindrical layers which are chosen of materials such that said first sleeve has a coefficient of thermal expansion higher than that of said second sleeve, wherein the thicknesses of said first and second sleeves are chosen, in relation to the thermal conductivity and coefficient of thermal expansion of the materials from which the sleeves are formed, so as to reduce, when said apparatus is in use, the difference between an axial expansion of said first sleeve along its longitudinal axis, which first sleeve is maintained at a low temperature by a circulating cooling fluid in said cooling channels, and an axial expansion of said second sleeve along its longitudinal axis, which second sleeve is maintained at a high temperature due to its contact with the molten metal.

2. The apparatus according to claim 1, characterized in that said first and second sleeves are joined to one another by welding.

3. The apparatus according to claim 1, characterized in that said first sleeve is made from a material comprising copper and said second sleeve is made from a material comprising steel, nickel or chromium.

4. The apparatus according to claim 1, wherein said first and second sleeves are joined to one another by charging one of said sleeves on the other.

5. The apparatus according to claim 1, wherein said first and second sleeves are joined to one another by electrolytic deposition.

6. The apparatus according to claim 1, wherein said first and second sleeves are made of materials which have different thermal conductivities.

7. The apparatus according to claim 1, wherein said first sleeve is thicker than said second sleeve.

8. The apparatus according to claim 1, wherein said first sleeve, has a thickness of about 5 to 30 mm and wherein said second sleeve has a thickness of about 1 to 10 mm.

9. An apparatus for the direct continuous casting of thin strips of molten metal, comprising:

a source of molten metal; and, at least one cooled roll which receives the molten metal to be solidified, said at least one roll having a longitudinal axis around which it rotates, said at least one roll comprising:

a cylindrical inner core having a longitudinal axis, a first sleeve enclosing said inner core, said first sleeve having a longitudinal axis parallel to the longitudinal axis of said core, cooling channels provided in said first sleeve, and a second sleeve enclosing said first sleeve and being in contact with the molten metal, said second sleeve having a longitudinal axis parallel to the longitudinal axis of said first sleeve and the longitudinal axis of said core and forming, with said first sleeve, two superposed cylindrical layers which are chosen of materials such that said first sleeve has a coefficient of thermal expansion higher than that of said second sleeve, wherein the thicknesses of said fist and second sleeves are chosen, in relation to the thermal conductivity and coefficient of thermal expansion of the materials from which the sleeves are formed, so as to reduce, when said apparatus is in use, the difference between an axial expansion of said first sleeve along its longitudinal axis, which first sleeve is maintained at a low temperature by a circulating cooling fluid in said cooling channels, and an axial expansion of said second sleeve along its longitudinal axis, which second sleeve is maintained at a high temperature due to its contact with the molten metal.

10. The apparatus according to claim 9, characterized in that said first and second sleeves are joined to one another by welding.

11. The apparatus according to claim 9, characterized in that said first sleeve is made from a material comprising copper and said second sleeve is made from a material comprising steel, nickel, or chromium.

12. The apparatus according to claim 9, wherein said first and second sleeves are joined to one another by charging one of said sleeves on the other.

13. The apparatus according to claim 9, wherein said first and second sleeves are joined to one another by electrolytic deposition.

14. The apparatus according to claim 9, wherein said first and second sleeves are made of materials which have different thermal conductivities.

15. The apparatus according to claim 9, wherein said first sleeve is thicker than said second sleeve.

16. The apparatus according to claim 9, wherein said first sleeve has a thickness of about 5 to 30 mm and wherein said second sleeve has a thickness of about 1 to 10 mm.

* * * * *